US005432324A

United States Patent [19]

Freewald

[11] Patent Number: 5,432,324

[45] Date of Patent: Jul. 11, 1995

[54] MICROWAVE COOKING SYSTEMS FOR RELEASING MOISTURE

[76] Inventor: Michael J. Freewald, 8405 4th St., Highland, Ind. 46322

[21] Appl. No.: 219,082

[22] Filed: Mar. 28, 1994

[51] Int. Cl.[6] ..... H05B 6/80

[52] U.S. Cl. ..... 219/731; 219/735; 99/DIG. 14; 426/109; 426/243

[58] Field of Search ..... 219/731, 735, 682; 426/109, 113, 241, 243; 99/DIG. 14

[56] References Cited

U.S. PATENT DOCUMENTS

| | | | |
|---|---|---|---|
| 4,345,512 | 8/1982 | Moore . | |
| 4,439,656 | 3/1984 | Peleg | 219/731 |
| 4,529,089 | 7/1985 | Gasbarra et al. | 426/109 |
| 4,560,850 | 12/1985 | Levendusky et al. | 219/731 |
| 4,705,927 | 11/1987 | Levendusky et al. | 219/731 |
| 4,795,649 | 1/1989 | Kearns et al. | 219/731 |
| 4,798,133 | 1/1989 | Johnson | 426/109 |
| 4,969,558 | 11/1990 | Fisher | 219/731 |

*Primary Examiner*—Philip H. Leung

[57] ABSTRACT

A microwave cooking system for releasing moisture comprised of a microwave plate and spherical shaped container. The microwave plate includes a planar circular bottom section with upper and lower surfaces. The periphery of the upper surface of the bottom section includes coupling means for attachment thereupon. It further includes an annular top section formed as a hollow rim, with the hollow interior including a contiguous space extending the entire length of the rim. The rim extends upward from the bottom section, and has interior and exterior side walls shaped to follow the contour of the perimeter of the bottom section. The rim also includes an upper surface and open lower surface adapted to couple to the upper surface of the bottom section. A plurality of apertures in the upper surface of the rim extend into the hollow interior. The system further includes a generally spherical shaped container formed as a hollow sphere. The outer shell of the container has an interior and exterior surface and is divided into two semi-spheres. The uppermost semi-sphere includes a plurality of apertures and coupling means around the circumference of the lower end. The lowermost semi-sphere includes a flat bottom at its lowermost extent and coupling means around the circumference of the upper end.

4 Claims, 3 Drawing Sheets

MICROWAVE COOKING SYSTEMS FOR RELEASING MOISTURE

BACKGROUND OF THE INVENTION

1. Field of the Invention

The present invention relates to microwave cooking systems for releasing moisture and more particularly pertains to releasing moisture in the form of steam into microwave oven chambers when cooking.

2. Description of the Prior Art

The use of microwave plates is known in the prior art. More specifically, microwave plates heretofore devised and utilized for the purpose of cooking or reheating food in microwave ovens are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,957,810 to Eleouet et al., synthetic sponge-type articles having excellent water retention.

U.S. Pat. No. 4,563,103 to Van Overloop et al. discloses a scrub sponge with opposed puncturing projections.

U.S. Pat. No. 4,608,395 to Hamada et al. discloses a silicone sponge rubber composition.

U.S. Pat. No. 4,104,435 to Ballesteros discloses a sponge.

U.S. Pat. No. DES. 332,841 to Levison discloses the ornamental design for a household sponge.

In this respect, the microwave cooking systems for releasing moisture according to the present invention substantially departs from the conventional concepts and designs of the prior art, and in doing so provides an apparatus primarily developed for the purpose of releasing moisture in the form of steam into microwave oven chambers when cooking.

Therefore, it can be appreciated that there exists a continuing need for new and improved microwave cooking systems for releasing moisture which can be used for releasing moisture in the form of steam into microwave oven chambers when cooking. In this regard, the present invention substantially fulfills this need.

SUMMARY OF THE INVENTION

In view of the foregoing disadvantages inherent in the known types of microwave plates now present in the prior art, the present invention provides an improved microwave cooking systems for releasing moisture. As such, the general purpose of the present invention, which will be described subsequently in greater detail, is to provide a new and improved microwave cooking systems for releasing moisture and method which has all the advantages of the prior art and none of the disadvantages.

To attain this, the present invention essentially comprises a new and improved microwave cooking system for releasing moisture consisting of a microwave plate, with a planar circular bottom section with upper and lower surfaces. The bottom section constitutes the base of the plate and is comprised of microwave safe materials. The periphery of the upper surface of the plate includes coupling means for attachment thereupon. The microwave plate also has an annular top section formed as a hollow rim which spans the entire circumference of the bottom section. The rim is comprised of microwave safe materials and extends vertically from the bottom section at about 90 degree angles to the plane of the bottom section. The rim is shaped in a generally rectangular cross-sectional configuration with rounded, parallel interior and exterior vertical side walls. The rim has a flat upper surface which is perpendicular to and contiguous with the sidewalls, and parallel to the plane of the bottom section. The open lower surface of the rim is adapted to couple to the upper surface of the bottom section. The hollow interior of the rim includes a contiguous space extending the entire circumference of the bottom section. A plurality of equidistantly spaced apertures in the upper surface of the rim extend into the hollow interior. The apertures are shaped in a generally rectangular configuration, with parallel long sides which conform to the contour of the circumference of the bottom section, and parallel short sides positioned perpendicular to the circumference of the bottom section. A synthetic first sponge is positioned inside the hollow interior of the rim. When the sponge is saturated with water and heated during microwave cooking, it releases steam into the microwave chamber through the apertures in the rim of the microwave plate. The system further includes a generally egg shaped container formed as a hollow sphere comprised of microwave safe materials. The container has interior and exterior surfaces and is divided at a center plane into two generally equally sized semi-spheres. The uppermost semi-sphere includes three circular apertures adjacent to its uppermost extent, with press-fit coupling means located around the circumference of the lower end so as to be releasably joined with the lowermost semi-sphere. The lowermost semi-sphere includes a flat bottom at its lowermost extent, with press-fit coupling means located around the circumference of the upper end so as to be releasably joined with the uppermost semi-sphere. A synthetic second sponge is contoured to the shape of the inside of the egg and positioned therein when in the joined, operative orientation. When the sponge is saturated with water and heated during microwave cooking, it releases steam into the microwave chamber through the apertures in the egg.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved microwave cooking systems for releasing moisture which have all the advantages of the prior art microwave plates and none of the disadvantages.

It is another object of the present invention to provide new and improved microwave cooking systems for releasing moisture which may be easily and efficiently manufactured and marketed.

It is further object of the present invention to provide new and improved microwave cooking systems for releasing moisture which are of durable and reliable constructions.

An even further object of the present invention is to provide new and improved microwave cooking systems for releasing moisture which are susceptible of a low cost of manufacture with regard to both materials and labor, and which accordingly are then susceptible of low prices of sale to the consuming public, thereby making such microwave cooking systems for releasing moisture economically available to the buying public.

Still yet another object of the present invention is to provide new and improved microwave cooking systems for releasing moisture which provide in the apparatuses and methods of the prior art some of the advantages thereof, while simultaneously overcoming some of the disadvantages normally associated therewith.

Still another object of the present invention is to release moisture in the form of steam into microwave oven chambers when cooking.

Lastly, it is an object of the present invention to provide new and improved microwave cooking systems for releasing moisture comprised of microwave plates and spherical shaped containers. The microwave plate includes a planar circular bottom section with upper and lower surfaces. The periphery of the upper surface of the bottom section includes coupling means for attachment thereupon. It further includes an annular top section formed as a hollow rim, with the hollow interior including a contiguous space extending the entire length of the rim. The rim extends upward from the bottom section, and has interior and exterior side walls shaped to follow the contour of the perimeter of the bottom section. The rim also includes an upper surface and open lower surface adapted to couple to the upper surface of the bottom section. A plurality of apertures in the upper surface of the rim extend into the hollow interior. The system further includes a generally spherical shaped container formed as a hollow sphere. The outer shell of the container has an interior and exterior surface and is divided into two semi-spheres. The uppermost semi-sphere includes a plurality of apertures and coupling means around the circumference of the lower end. The lowermost semi-sphere includes a flat bottom at its lowermost extent and coupling means around the circumference of the upper end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
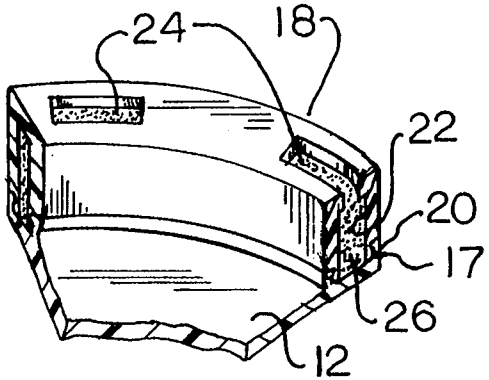
FIG. 2 is an enlarged, broken away perspective view of the microwave plate taken at section 2 of FIG. 1, revealing the hollow space and apertures in the rim, and the synthetic sponge material positioned within the hollow space.
Figure 1:
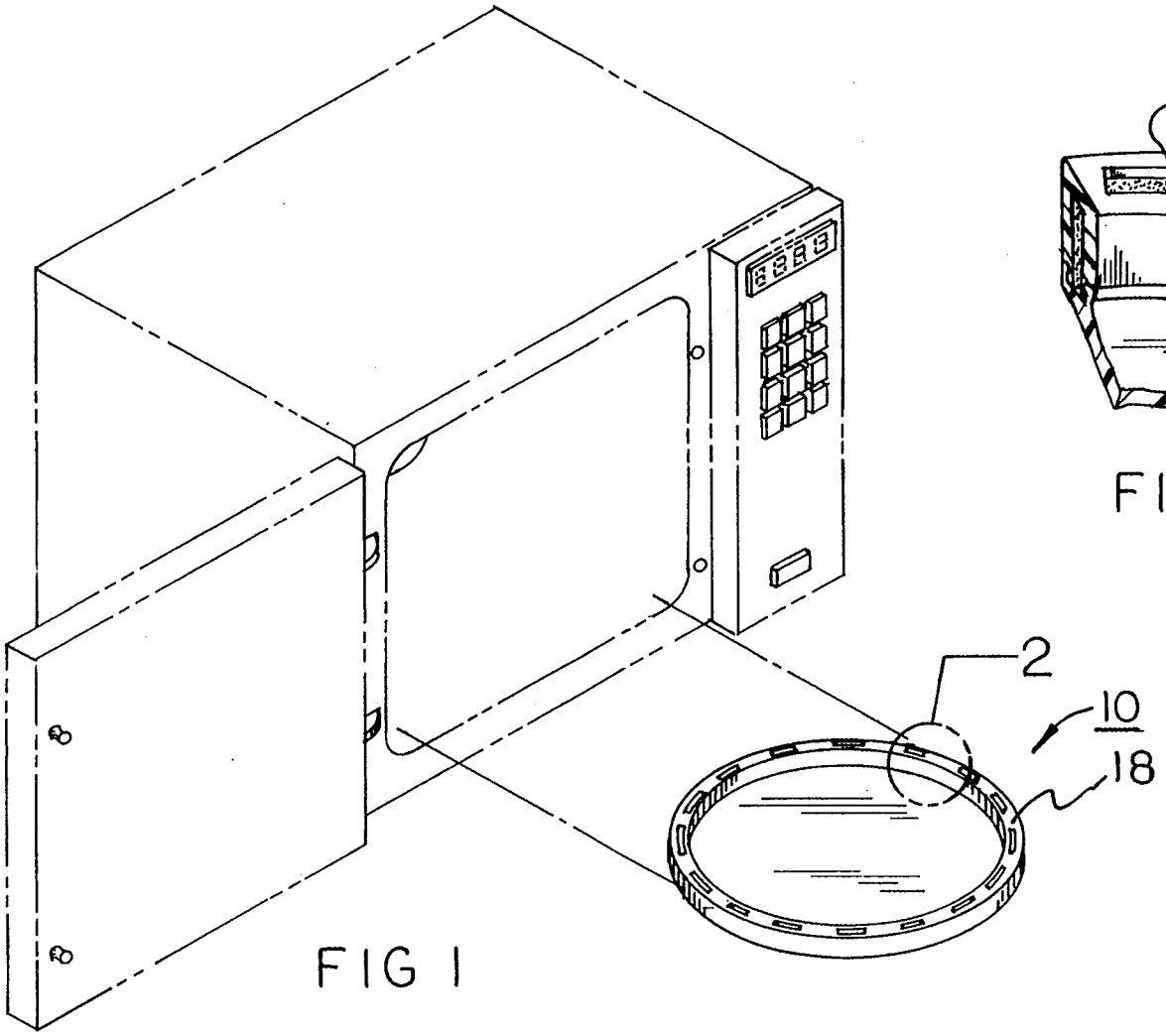
FIG. 1 is a perspective view of the preferred embodiment of the microwave plate constructed in accordance with the principles of the present invention.
Figure 3:
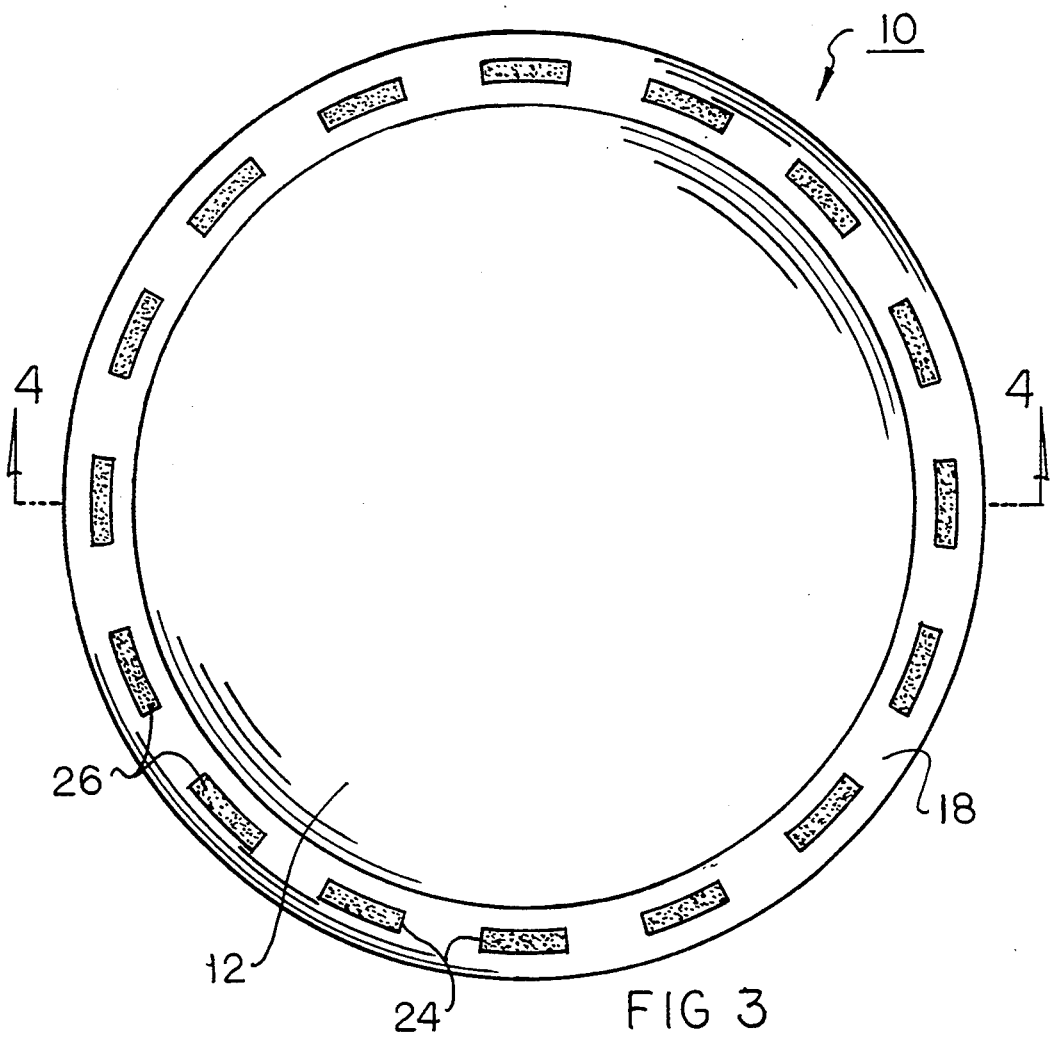
FIG. 3 is a top plan view of the microwave plate shown in FIG. 1.
Figure 4:
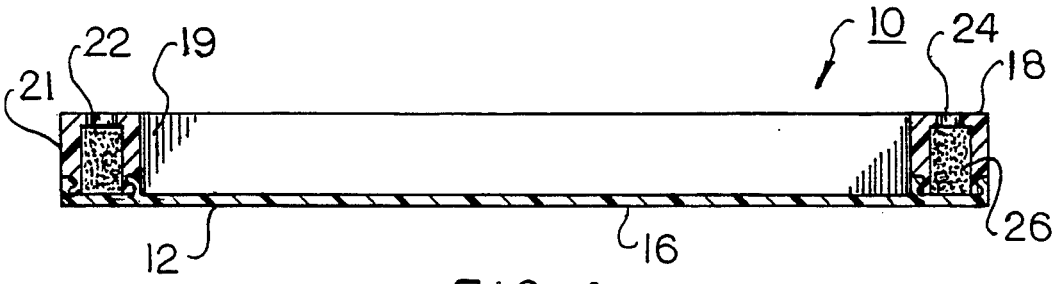
FIG. 4 is a cross-sectional view of the microwave plate taken along line 4—4 of FIG. 3.
Figure 5:
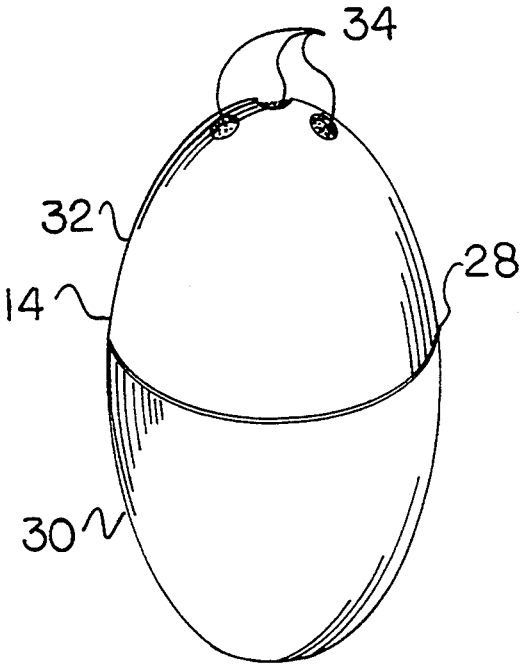
FIG. 5 is a perspective view of the preferred embodiment of the egg shaped container constructed in accordance with the principles of the present invention.
Figure 6:
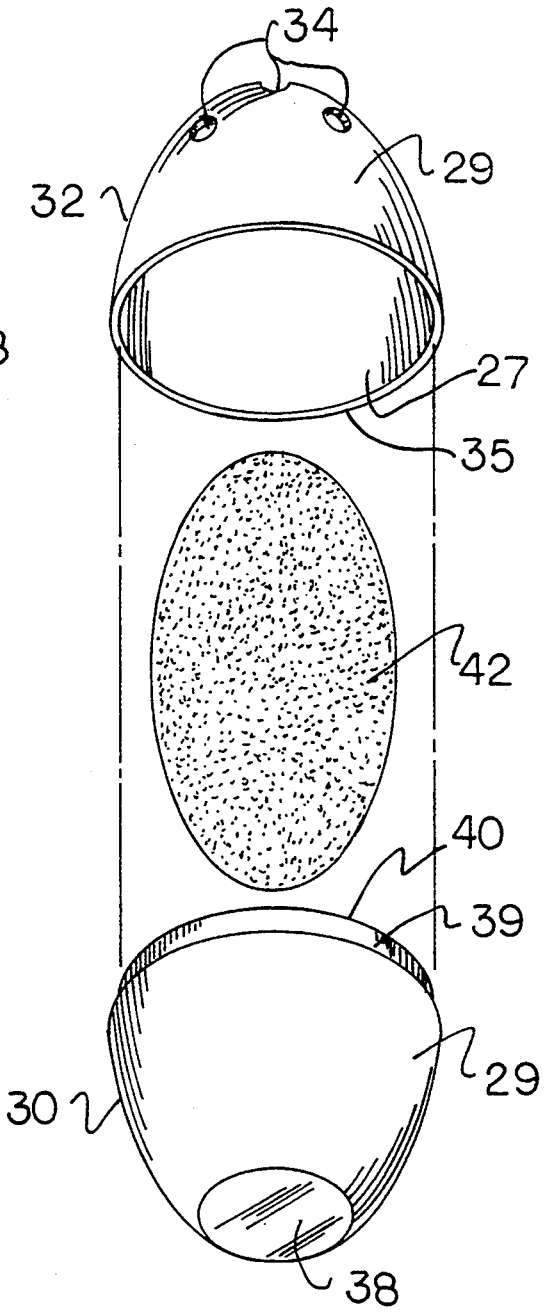
FIG. 6 is a separated, perspective view of the egg shaped container shown in FIG. 5 revealing the two disconnected semi-spheres and the egg shaped synthetic sponge contained within.

With reference now to the drawings, and in particular to FIG. 1 thereof, the preferred embodiment of the new and improved microwave cooking systems for releasing moisture embodying the principles and concepts of the present invention and generally designated by the reference numeral 10 will be described.

Specifically, it will be noted in FIGS. 1 through 6, that there is provided a new and improved microwave cooking system 10 for releasing moisture. The cooking system 10, in its broadest context, comprises a microwave plate 12 and an egg shaped container 14.

More specifically, the microwave plate 12, has a planar circular bottom section 16 with upper and lower surfaces. The bottom section 16 constitutes the base of the plate and is comprised of microwave safe materials. The periphery of the upper surface of the bottom section 16 includes coupling means 17 for attachment thereupon. Food is placed on the bottom section 16 of the microwave plate when cooking is desired. The plate may be placed directly into the oven or set on top of a microwave turntable. Note in particular FIGS. 1 and 2.

The second component of the cooking system is an annular top section formed as a hollow rim 18 which spans the entire circumference of the bottom section 16. The rim 18 is comprised of microwave safe materials and extends vertically from the bottom section 16 at about 90 degree angles to the plane of the bottom section 16. The rim 18 is shaped in a generally rectangular cross-sectional configuration with rounded, parallel interior and exterior vertical side walls 19, 21. The rim 18 has a flat upper surface which is perpendicular to and contiguous with the sidewalls 19, 21, and parallel to the plane of the bottom section 16. The open lower surface 20 of the rim is adapted to couple to the upper surface of the bottom section 16. The hollow interior of the rim 18 includes a contiguous space 22 extending the entire circumference of the bottom section 16. The hollow rim 18 of the microwave plate is easily detached from the bottom section 16 to aid the user in cleaning the apparatus. Note FIGS. 2 and 3.

A plurality of equidistantly spaced apertures 24 in the upper surface of the rim extend into the hollow interior 22. The apertures 24 are shaped in a generally rectangular configuration, with parallel long sides which conform to the contour of the circumference of the bottom section 16, and parallel short sides positioned perpendicular to the circumference of the bottom section 16. Note FIG. 3.

A synthetic first sponge 26 is positioned inside the hollow interior 22 of the rim 18. When the synthetic first sponge 26 is saturated with water and heated during microwave cooking, it releases steam into the microwave chamber through the apertures 24 in the hollow rim 18 of the microwave plate 12. To saturate the synthetic first sponge 26 with water the user simply holds the hollow rim 18 of the microwave plate 12 under a common water faucet allowing water to pass through the apertures 24 in the hollow rim 18. During microwave cooking the water contained within the synthetic first sponge 26 experiences a rapid increase in temperature and is converted into the gaseous state, steam. The large number of apertures 24 allows a steady flow of steam to be released into the oven. The steam aids the cooking process by keeping food moist thereby preventing burning. The steam also helps to retain flavor within the food. The hollow rim 18 is easily detached from the bottom section 16 to clean or replace the synthetic first sponge 26. Note FIGS. 2 and 4.

The system further includes a generally egg shaped container 14 formed as a hollow sphere comprised of microwave safe materials. The container has interior and exterior surfaces 27, 29 and is divided at a center plane 28 into two generally equally sized semi-spheres 30, 32. The uppermost semi-sphere 30 includes three circular apertures 34 adjacent to its uppermost extent, with press-fit coupling means 35 located around the circumference of the lower end 36 so as to be releasably joined with the lowermost semi-sphere 32. The lowermost semi-sphere 32 includes a flat bottom 38 at its lowermost extent, with press-fit coupling means 39 located around the circumference of the upper end 40 so as to be releasably joined with the uppermost semi-sphere 30. The flat bottom of the egg-shaped container permits the user to firmly position it within the microwave plate or on the floor of a microwave oven chamber. The semi-spheres are easily detached by the user to aid in cleaning. Note FIGS.5 and 6.

A synthetic second sponge 42 is contoured to the shape of the inside of the egg shaped container 14 and positioned therein when in the joined, operative orientation. When the synthetic second sponge 42 is saturated with water and heated during microwave cooking, it releases steam into the microwave chamber through the apertures 34 in the container. To saturate the synthetic second sponge 42 with water the user simply holds the egg shaped container 14 under a common water faucet allowing water to pass through the apertures 34. During microwave cooking the water contained within the synthetic second sponge 42 experiences a rapid increase in temperature and is converted into the gaseous state, steam. The apertures 34 allow a steady flow of steam to be released into the oven. The egg-shaped container is adapted to be positioned within the microwave chamber alone or along with the microwave plate, the egg-shaped container being the sole source of steam within the microwave chamber or supplementing the steam produced by the microwave plate. The steam aids the cooking process by keeping food moist thereby preventing burning. The steam also helps to retain flavor within the food. The semi-spheres are easily separated from each other to clean or replace the synthetic second sponge. Note FIG. 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved microwave cooking system for releasing moisture comprising, in combination:

a microwave plate, with a planar circular bottom section with upper and lower surfaces, the bottom section constituting the base of the plate, the bottom section being comprised of microwave safe materials with the periphery of the upper surface including coupling means for attachment thereupon;

the microwave plate also having an annular top section formed as a hollow rim and spanning the entire circumference of the bottom section, the rim being comprised of microwave safe materials and extending vertically from the bottom section at about 90 degree angles to the plane of the bottom section, the rim being shaped in a generally rectangular cross-sectional configuration with rounded, parallel interior and exterior vertical side walls, with a flat upper surface perpendicular to and contiguous with the sidewalls and parallel to the plane of the bottom section, with an open lower surface adapted to couple to the upper surface of the bottom section, with the hollow interior of the rim including a contiguous space extending the entire circumference of the bottom section;

a plurality of equidistantly spaced apertures in the upper surface of the rim which extend into the hollow interior of the rim, the apertures shaped in a generally rectangular configuration, with parallel long sides which conform to the contour of the circumference of the bottom section, and with parallel short sides positioned perpendicular to the circumference of the bottom section;

a synthetic first sponge positioned inside the hollow interior of the rim which, when saturated with water and heated during microwave cooking, releases steam into the microwave chamber through the apertures in the rim of the plate;

the system further including a generally egg shaped container formed as a hollow sphere comprised of microwave safe materials, the container having an interior and exterior surface and divided at a center plane into two generally equally sized semi-spheres, the egg-shaped container adapted to be positioned within the chamber of a microwave oven alone or along with the microwave plate, the egg-shaped container being the sole source of steam within the microwave chamber or supplementing the steam produced by the microwave plate;

the uppermost semi-sphere including three circular apertures adjacent to its uppermost extent, with press-fit coupling means located around the circumference of the lower end so as to be releasably joined with the lowermost semi-sphere;

the lowermost semi-sphere including a flat bottom at its lowermost extent, with press-fit coupling means located around the circumference of the upper end so as to be releasably joined with the uppermost semi-sphere, the flat bottom of the egg-shaped container permitting the user to firmly position it within the microwave plate or on the floor of the microwave oven chamber; and a synthetic second sponge contoured to the shape of the inside of the egg shaped container and positioned therein when in the joined, operative orientation, the sponge, which when saturated with water and heated during microwave cooking, releases steam into the microwave chamber through the apertures in the container.

2. A microwave cooking system for releasing moisture comprising:

at least one container fabricated of microwave safe materials, in the operative orientation each container being positioned in a microwave oven chamber, each container having a hollow interior and including coupling means to permit separation into two or more segments, at least one segment of each container having a plurality of apertures, each container including a synthetic sponge positioned therein, each sponge, which when saturated with water and heated during microwave cooking, releases steam into a microwave chamber through the apertures in its container.

3. The apparatus as set forth in claim 2 wherein one of said at least one container is a microwave plate, the plate having a planar generally circular bottom section with upper and lower surfaces, the bottom section constituting the base of the plate and comprised of microwave safe materials with the periphery of the upper surface including coupling means for attachment thereupon;

the plate also having an annular top section formed as a hollow rim and spanning the entire circumference of the bottom section, with the hollow interior including a contiguous space extending the entire length of the rim, the rim being comprised of microwave safe materials and extending virtually upward from the bottom section, with interior and exterior side walls shaped to follow the contour of the perimeter of the bottom section, the rim also including an upper surface and open lower surface adapted to couple to the upper surface of the bottom section;

a plurality of equidistantly spaced apertures in the upper surface of the rim which extend into the hollow interior; and the synthetic sponge being positioned inside the hollow interior of the rim which, when saturated with water and heated during microwave cooking, releases steam into the microwave chamber through the apertures in the rim of the plate.

4. The apparatus as set forth in claim 2 wherein one of said at least one container is formed in a generally egg-shaped configuration, the egg-shaped container being comprised of microwave safe materials and formed of upper and lower hollow semi-spheres with interior and exterior surfaces and top and bottom ends;

the upper semi-sphere including a plurality of apertures, coupling means being located around the circumference of its bottom end so as to be releasably joined with the lower semi-sphere;

the lower semi-sphere including a flat bottom at its bottom end, coupling means being located around the circumference of its top end so as to be releasably joined with the upper semi-sphere; and the synthetic sponge being contoured to the shape of the inside of the egg shaped container and positioned within it when in the joined, operative orientation, the sponge, which when saturated with water and heated during microwave cooking, releases steam into the microwave chamber through the apertures in the container.

* * * * *